US007051770B2

(12) United States Patent
Sasaki et al.

(10) Patent No.: US 7,051,770 B2
(45) Date of Patent: May 30, 2006

(54) COIL-WINDING METHOD AND COIL UNIT FORMED BY THE METHOD

(75) Inventors: Koki Sasaki, Fukui (JP); Takaomi Toi, Machida (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 114 days.

(21) Appl. No.: 10/935,114

(22) Filed: Sep. 8, 2004

(65) Prior Publication Data

US 2005/0115628 A1 Jun. 2, 2005

(30) Foreign Application Priority Data

Dec. 2, 2003 (JP) ..... 2003-403469

(51) Int. Cl.

| | |
|---|---|
| ***B21F 3/00*** | (2006.01) |
| ***B21C 47/14*** | (2006.01) |
| ***B21C 47/02*** | (2006.01) |
| ***H01F 41/06*** | (2006.01) |

(52) U.S. Cl. ..... 140/92.1; 140/92.2; 72/371; 242/439; 242/439.5; 242/443; 242/444

(58) Field of Classification Search ..... 140/92.1, 140/92.2; 72/66, 135, 142, 146, 148, 371; 29/596, 605, 732, 736; 242/439, 439.4, 439.5, 242/443, 443.1, 444

See application file for complete search history.

(56) References Cited

U.S. PATENT DOCUMENTS 2,559,824 A * 7/1951 Leland ..... 140/92.2
3,801,029 A * 4/1974 Malburg ..... 29/605

FOREIGN PATENT DOCUMENTS

| | | |
|---|---|---|
| JP | 63296323 A * | 12/1988 |
| JP | 03-018724 | 3/1991 |
| JP | 06-318528 | 11/1994 |
| JP | 2004-119922 | 4/2004 |

* cited by examiner

*Primary Examiner*—Dmitry Suhol
(74) *Attorney, Agent, or Firm*—Keating & Bennett, LLP

(57) ABSTRACT

A coil-winding method for forming a coil unit includes the steps of winding first and second wires substantially parallel to each other simultaneously around a first layer position of a core to form a first turn, winding the first and second wires simultaneously to form a second turn while the second wire is disposed directly around the core, the first wire of the second turn adjacent to the first turn being disposed between the first and second wires of the first turn in the first layer so as to form a second layer, and winding the first and second wires simultaneously to form a third turn while the second wire is disposed directly around the core, the first wire of the third turn being disposed in the second layer and wound between the second wire of the first turn and the second wire of the second turn in the first layer.

18 Claims, 18 Drawing Sheets

COIL-WINDING METHOD AND COIL UNIT FORMED BY THE METHOD

BACKGROUND OF THE INVENTION

1. Field of the Invention

The present invention relates to coil-winding methods and coil units formed by such methods.

2. Description of the Related Art

Japanese Unexamined Patent Application Publication No. 6-318528 discloses a typical coil-winding method for forming a wire-wound coil unit having a double-layered structure. In such a coil unit, wires are wound around a magnetic core component in a double-layered manner. According to such a method, a first wire is first wound around the core component to form a first layer, and a second wire is wound over the first layer to form a second layer.

Such a method, however, requires twice as much time for the winding process in comparison with single-layer wire winding since the second wire in the second layer is wound only after the winding of the first layer has been completed.

SUMMARY OF THE INVENTION

In order to overcome the problems described above, preferred embodiments of the present invention provide a coil-winding method that reduces the time required for the winding process and that allows for multilayered winding of wires. Preferred embodiments of the present invention also provide a coil unit formed by such a unique method.

According to a first preferred embodiment of the present invention, a coil-winding method includes the steps of winding a first wire and a second wire simultaneously around a first layer position of a core so as to form a first turn, the first wire and the second wire being parallel or substantially parallel to each other, winding the first wire and the second wire simultaneously around the core to form a second turn, the first wire of the second turn being adjacent to the first turn, the first wire of the second turn being disposed on a section between the first wire and the second wire of the first turn in the first layer of the core such that the first wire of the second turn is disposed in a second layer of the core, the second wire of the second turn being wound directly around the core such that the second wire of the second turn is disposed in the first layer of the core, and winding the first wire and the second wire simultaneously around the core to form a third turn, the first wire of the third turn being disposed in the second layer and wound around a section between the second wire of the first turn and the second wire of the second turn in the first layer, the second wire of the third turn being wound directly around the core such that the second wire of the third turn is disposed in the first layer of the core.

Furthermore, according to a second preferred embodiment of the present invention, a coil-winding method includes the steps of winding a first wire, a second wire, and a third wire simultaneously around a first layer position of a core so as to form a first turn, the first, second, and third wires being parallel or substantially parallel to one another, winding the first, second, and third wires simultaneously around the core to form a second turn, the first and second wires of the second turn being closer to the first turn than the third wire of the second turn, the first wire of the second turn being disposed on a section between the first wire and the second wire of the first turn in the first layer of the core such that the first wire of the second turn is disposed in a second layer of the core, the second wire of the second turn being disposed on a section between the second wire and the third wire of the first turn in the first layer such that the second wire of the second turn is also disposed in the second layer, the third wire of the second turn being wound directly around the core such that the third wire of the second turn is disposed in the first layer of the core, winding the first, second, and third wires simultaneously around the core to form a third turn, the second wire of the third turn being wound around a section between the third wire of the first turn and the third wire of the second turn in the first layer such that the second wire of the third turn is disposed in the second layer, the first wire of the third turn being wound around a section between the first wire of the second turn and the second wire of the second turn in the second layer such that the first wire of the third turn is disposed in a third layer of the core, the third wire of the third turn being wound directly around the core such that the third wire of the third turn is disposed in the first layer of the core, and winding the first, second, and third wires simultaneously around the core such that the first wire of the third layer is wound around a section between adjacent turns of the second wire in the second layer, the second wire of the second layer is wound around a section between adjacent turns of the third wire in the first layer, and the third wire of the first layer is wound directly around the core.

Furthermore, according to a third preferred embodiment of the present invention, a coil unit includes a plurality of wires and a core, in which the wires are wound around the core based on the method according to one of the first and second preferred embodiments of the present invention described above.

According to preferred embodiments of the present invention, the first layer can be formed with one of the wires while simultaneously forming two or more layers over the first layer with the remaining wires. Consequently, a multilayered coil unit can be obtained, in which the wires in the corresponding layers are wound parallel or substantially parallel to one another. Thus, the time required for the winding process according to the coil-winding method of preferred embodiments of the present invention is much shorter in comparison with the conventional coil-winding method.

Other features, elements, steps, characteristics and advantages of the present invention will become more apparent from the following detailed description of preferred embodiments thereof with reference to the attached drawings.

DETAILED DESCRIPTION OF PREFERRED EMBODIMENTS

Preferred embodiments of a coil-winding method and a coil unit formed by such a method according to the present invention will now be described with reference to the drawings.

First Preferred Embodiment (FIGS. 1 to 10)

Figure 1:
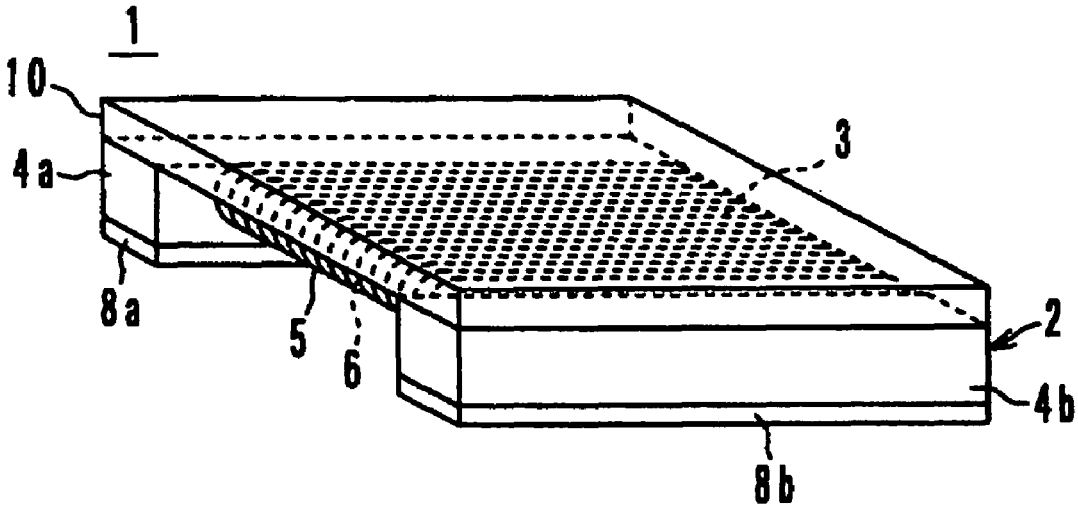
FIG. 1 is a schematic perspective view of a coil unit according to a first preferred embodiment of the present invention.

FIG. 1 is a schematic perspective view of a coil unit 1 according to a first preferred embodiment of the present invention. The coil unit 1 preferably includes a magnetic core component 2, a first wire 5, and a second wire 6. The core component 2 is provided with a core plate 3 around which the first wire 5 and the second wire 6 are wound in a double-layered manner while being kept parallel or substantially parallel to each other, and leg portions 4*a* and 4*b* respectively provided at two opposite sides of the core plate 3.

The bottom surfaces of the leg portions 4*a* and 4*b* are respectively provided with electrodes 8*a* and 8*b*. One end of each of the wires 5 and 6 is electrically connected with the electrode 8*a*, and the other end of each of the wires 5 and 6 is electrically connected with the electrode 8*b*. The first wire 5 is mainly wound around a second layer position of the core plate 3, and the second wire 6 is mainly wound around a first layer position of the core plate 3.

The top surface of the coil unit 1 is provided with a resin member 10 containing magnetic particles such that the resin member 10 covers the wires 5 and 6.

The winding method of the coil unit 1 will now be described in detail.

Figure 2:
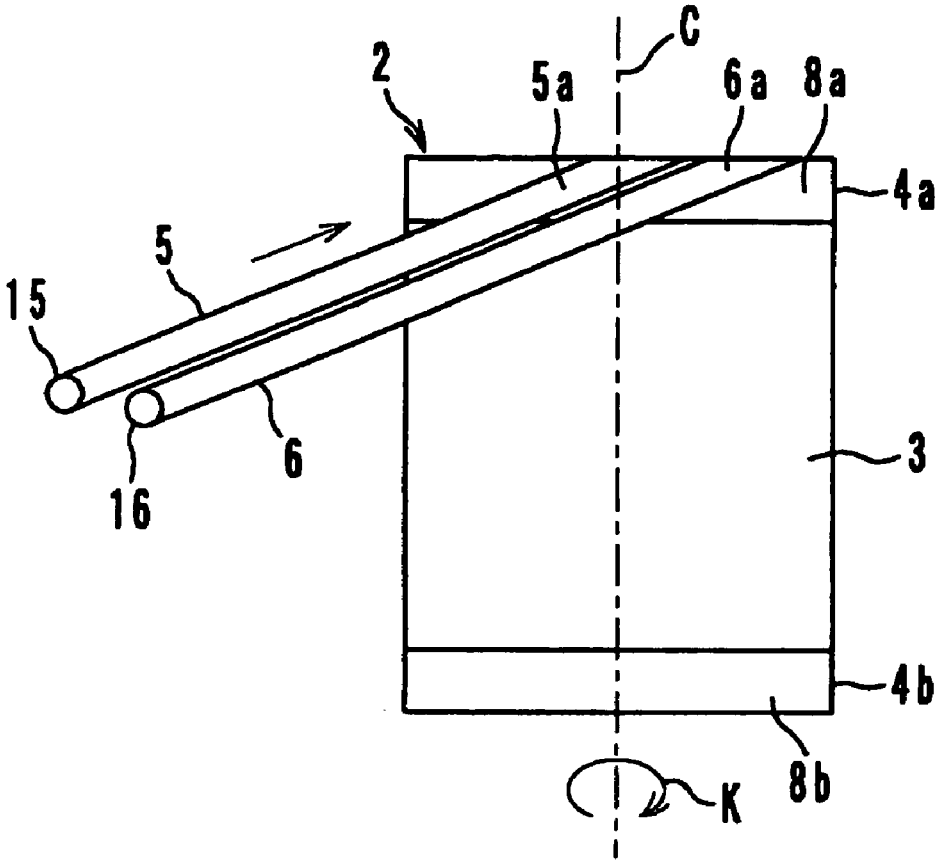
FIG. 2 is a plan view illustrating one of the steps of a coil-winding method according to the first preferred embodiment of the present invention.
Figure 3:
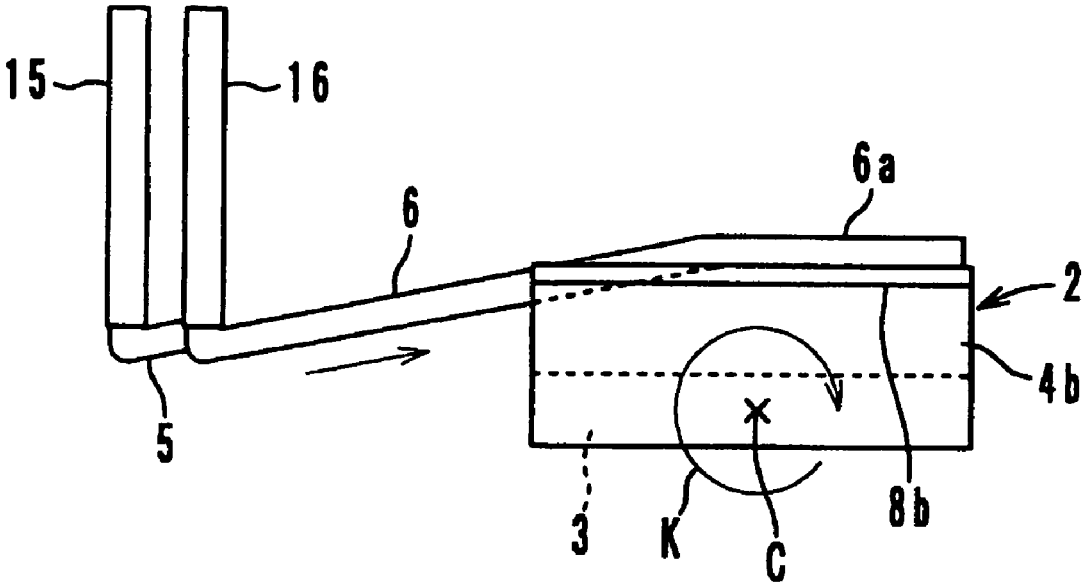
FIG. 3 is a front view of FIG. 2.

Referring to FIGS. 2 and 3, the core component 2 without the resin member 10 is held by a clamping mechanism, which is not shown in the drawings, of a known spindle winder, and is set in a rotatable manner such that the core component 2 is capable of rotating in a direction indicated by an arrow K, i.e. clockwise direction, around a central axis C.

Subsequently, two wire-supplying nozzles 15 and 16 of the spindle winder disposed adjacent to the core component 2 respectively supply the wires 5 and 6. First ends 5*a* and 6*a* of the respective wires 5 and 6 are then fixed to and electrically connected to the electrode 8*a* of the leg portion 4*a* by, for example, thermo-compression bonding. In synchronization with the rotation of the core component 2, the wire-supplying nozzles 15 and 16 are moved parallel or substantially parallel to the central axis C of the core component 2 by a parallel-shifting motor.

Figure 4:
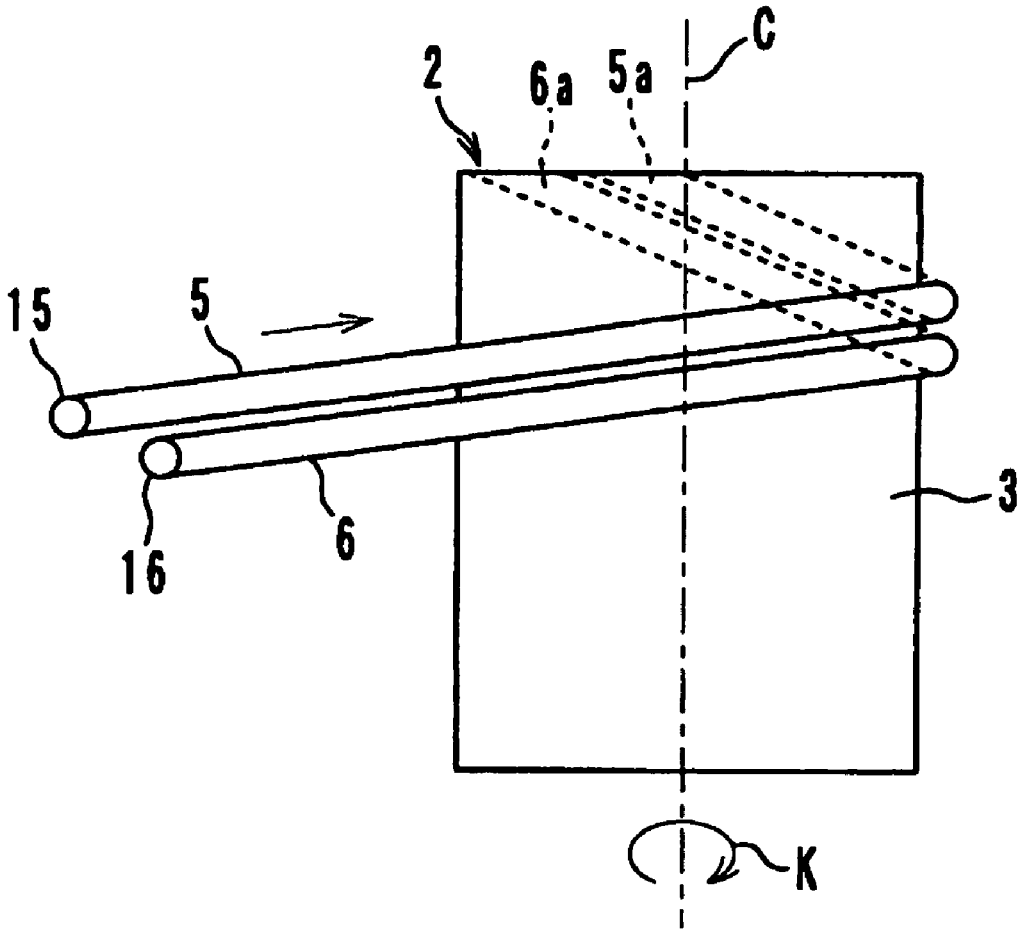
FIG. 4 is a plan view illustrating another step following the step in FIG. 2.
Figure 5:
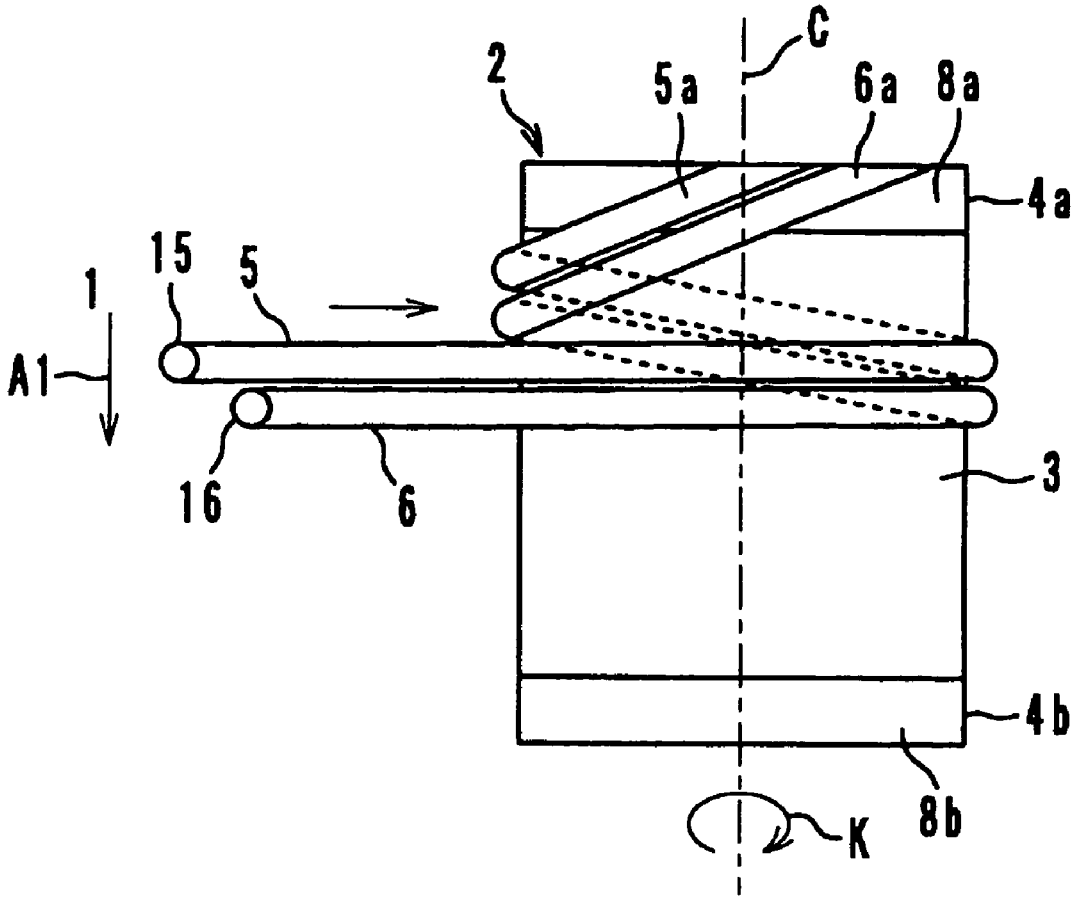
FIG. 5 is a plan view illustrating another step following the step in FIG. 4.

Referring to FIG. 4, when the core component 2 is rotated by approximately 180° around the central axis C in the direction of the arrow K, the wires 5 and 6 are wound around a first layer position of the core plate 3 while being kept parallel or substantially parallel and substantially in contact with each other. Referring to FIG. 5, when the core component 2 is further rotated by approximately 180°, the wires 5 and 6 wrap completely around the core plate 3 while still being kept parallel or substantially parallel to each other so as to form a first turn.

Subsequently, while the wire-supplying nozzles 15 and 16 are shifted forward in a direction indicated by an arrow A1, which is substantially parallel to the central axis C of the core component 2, the core component 2 is further rotated so as to wind the wires 5 and 6 around the core plate 3. This starts a winding process for a second turn in the first layer position of the core plate 3 while the second turn is in contact with the first turn.

Figure 6:
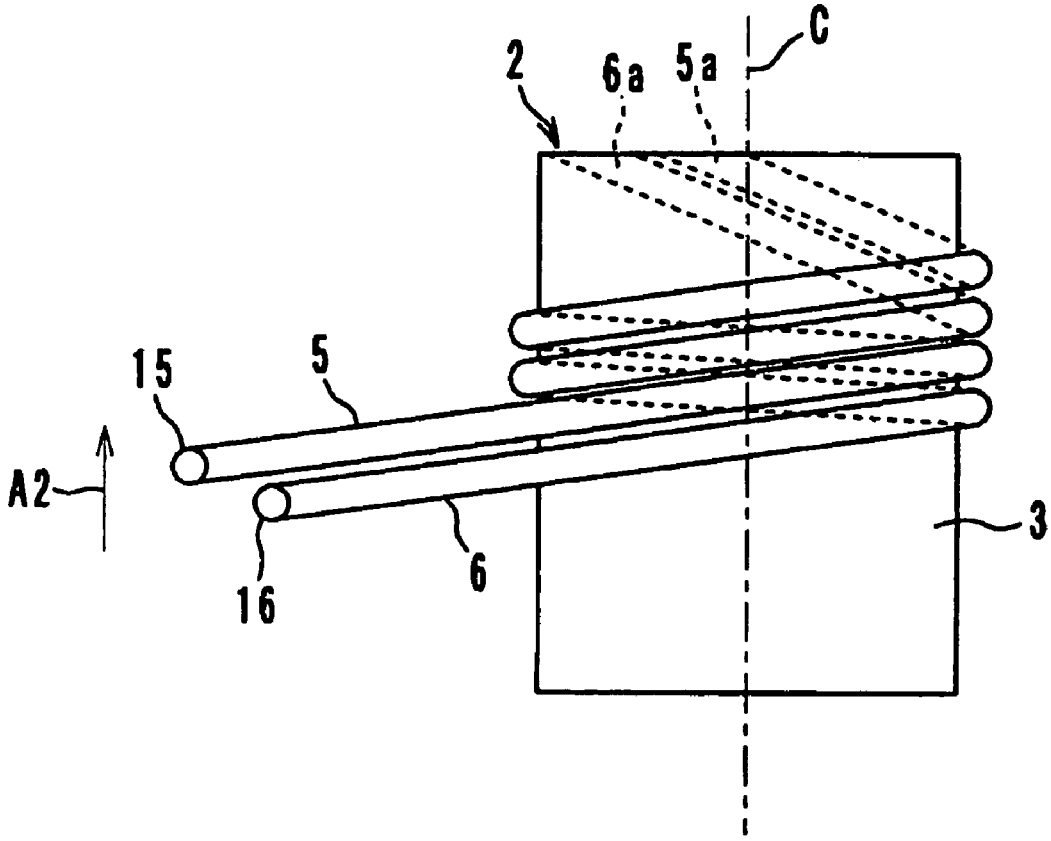
FIG. 6 is a plan view illustrating another step following the step in FIG. 5.
Figure 7:
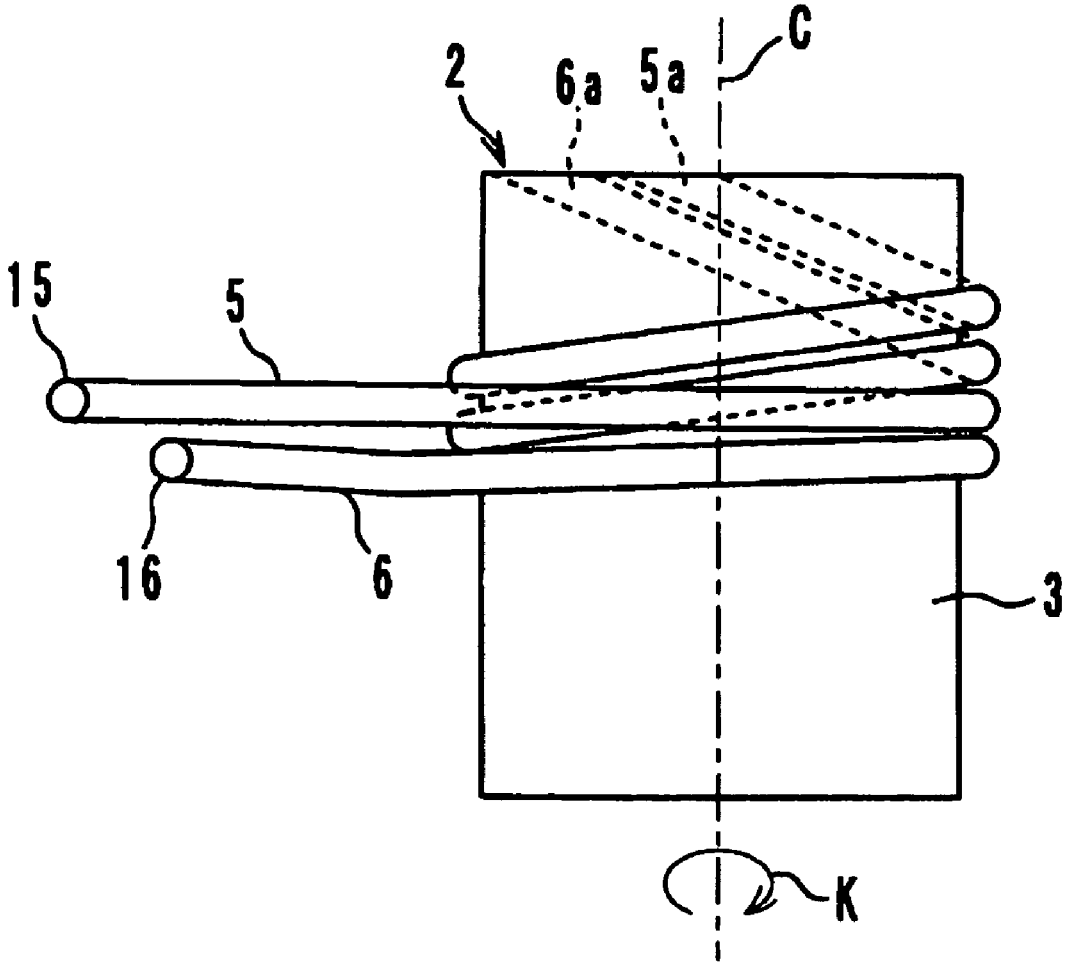
FIG. 7 is a plan view illustrating another step following the step in FIG. 6.

Referring to FIG. 6, after the core component 2 is rotated by approximately 180°, the wire-supplying nozzles 15 and 16 are shifted backwards in a direction indicated by an arrow A2 (opposite to the direction of the arrow A1), which is substantially parallel to the central axis C of the core component 2. In detail, referring to FIG. 7, the wire-supplying nozzles 15 and 16 are shifted backwards by a distance approximately 0.5 times to approximately 0.75 times the winding pitch of the first wire 5. Thus, the first wire 5 of the second turn adjacent to the first turn is disposed on a section between the first wire 5 and the second wire 6 of the first turn, and is wound around the core plate 3 to form the second layer. On the other hand, the second wire 6 of the second turn is disposed in the first layer of the core plate 3 while being adjacent to and in contact with the second wire 6 of the first turn.

Figure 8:
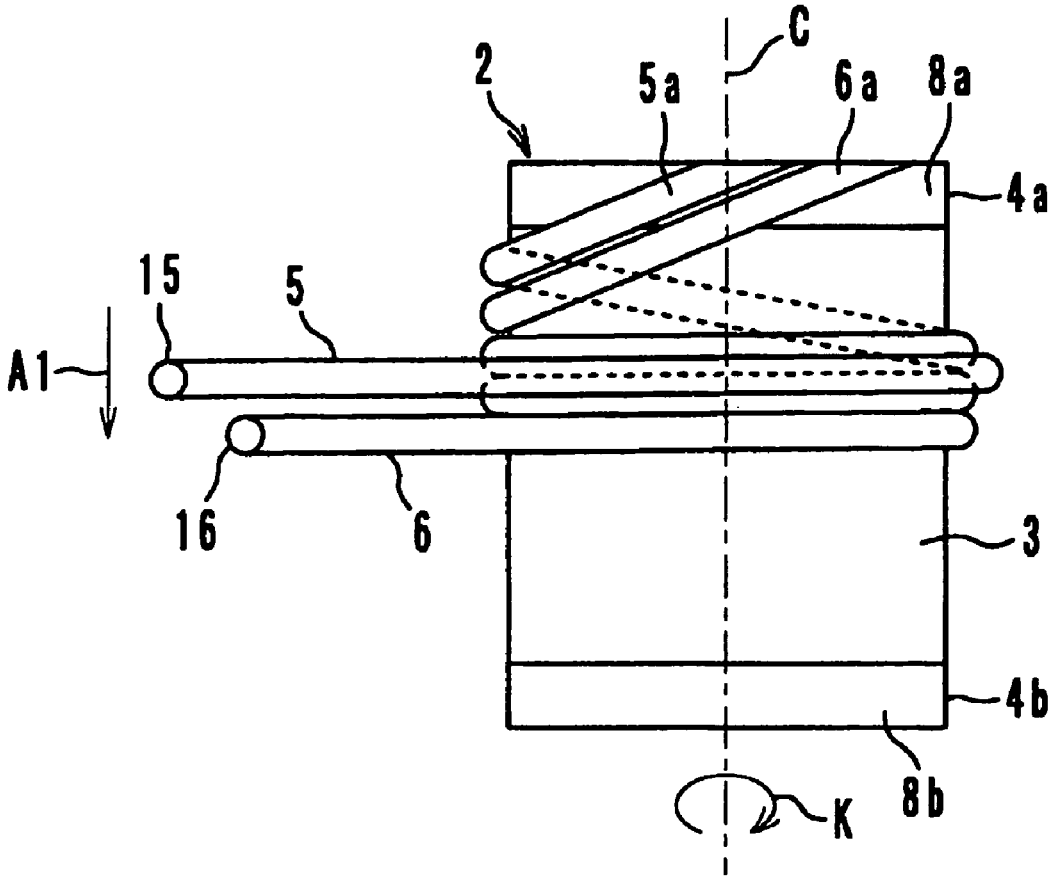
FIG. 8 is a plan view illustrating another step following the step in FIG. 7.

Subsequently, referring to FIG. 8, the core component 2 is rotated a predetermined number of times to wind the wires 5 and 6 around the core plate 3 while the wire-supplying nozzles 15 and 16 are shifted forward in the direction of the arrow A1. Accordingly, the wound second wire 6 forms the first layer of the core plate 3 while the adjacent turns of the second wire 6 are in contact with each other. On the other hand, the first wire 5 is wound around a section between the adjacent turns of the second wire 6 in the first layer so as to be disposed in the second layer position of the core plate 3 while the adjacent turns of the first wire 5 are in contact with each other. After the winding process of the wires 5 and 6 is completed, second ends 5*b* and 6*b* of the respective wires 5 and 6 are fixed to and electrically connected to the electrode 8*b* in the leg portion 4*b* by, for example, thermo-compression bonding.

Figure 9:
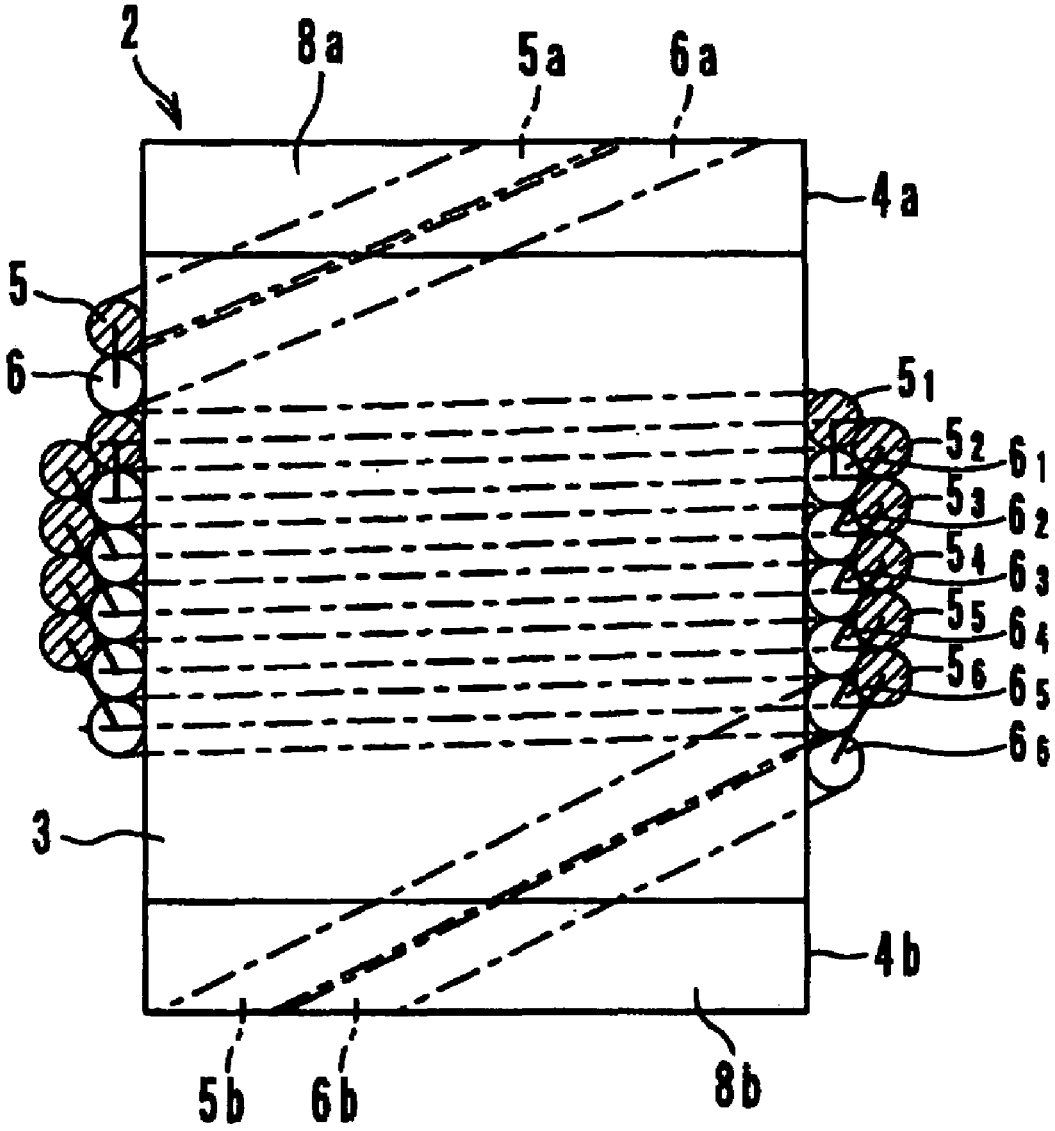
FIG. 9 is a schematic cross-sectional view illustrating a state where wires are wound around a core plate of the coil unit.

FIG. 9 is a schematic cross-sectional view illustrating a state where the wires 5 and 6 are wound around the core plate 3. Subscript numerals provided for each of the wires 5 and 6 indicate the turn number. For example, reference numeral 51 indicates the first turn of the first wire 5. As is apparent from FIG. 9, the first turn of the wires 5 and 6 wound around the core plate 3 is asymmetrical to the last turn of the wires 5 and 6.

Figure 10:
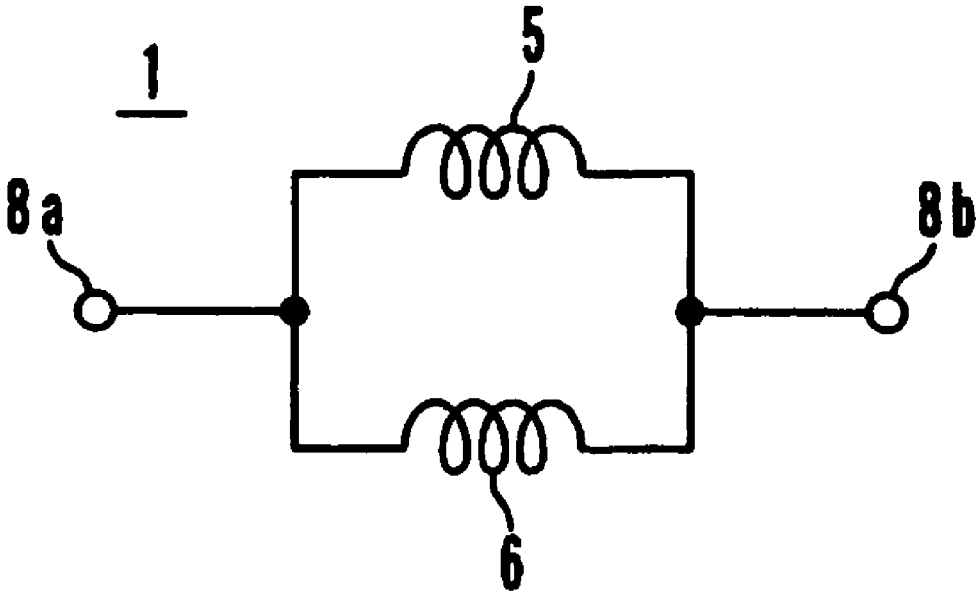
FIG. 10 is an electrical equivalent circuit diagram of the coil unit shown in FIG. 1.

According to the coil-winding method of the first preferred embodiment described above, the first layer of the second wire 6 can be formed on the core plate 3 while simultaneously forming the first wire 5 of the second layer over the first layer, meaning that the two wires 5 and 6 can be wound around the core plate 3 at the same time. Accordingly, a double-layered coil unit 1 can be obtained, in which the wires 5 and 6 in the respective first layer and second layer are wound parallel or substantially parallel to each other. Thus, the time required for the winding process according to the first preferred embodiment of the present invention is about half the time required in the conventional coil winding process. FIG. 10 illustrates an electrical equivalent circuit of the coil unit 1.

Second Preferred Embodiment (FIGS. 11 to 18)

A second preferred embodiment according to the present invention will now be described. According to the second preferred embodiment, the core component 2 in the first preferred embodiment is further provided with a third wire 7, such that the first wire 5, the second wire 6, and the third wire 7 are wound in a triple-layered manner while being kept parallel or substantially parallel to one another.

Figure 11:
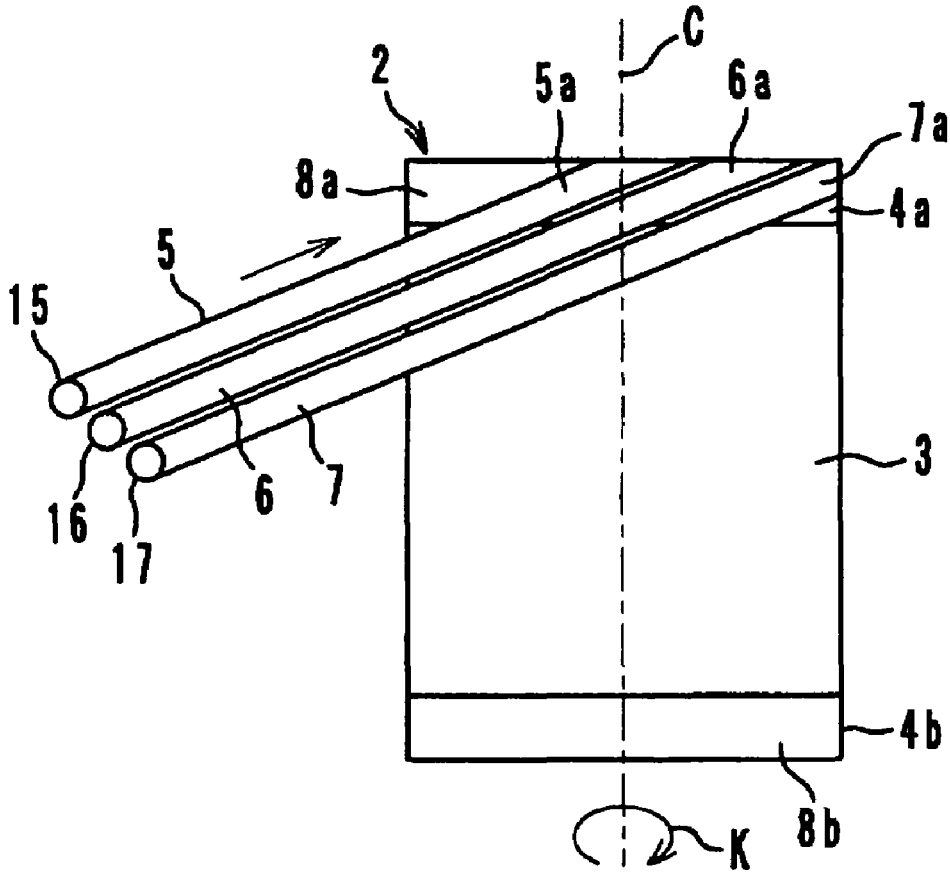
FIG. 11 is a plan view illustrating one of the steps of the coil-winding method according to a second preferred embodiment of the present invention.

Referring to FIG. 11, the wire-supplying nozzles 15 and 16 and a wire-supplying nozzle 17 of the spindle winder disposed adjacent to the core component 2 respectively supply the first wire 5, the second wire 6, and the third wire 7. First ends 5*a*, 6*a*, and 7*a* of the respective wires 5, 6, and 7 are then fixed to and electrically connected to the electrode 8*a* of the leg portion 4*a* by, for example, thermo-compression bonding. In synchronization with the rotation of the core component 2, the wire-supplying nozzles 15, 16, and 17 are moved parallel or substantially parallel to the central axis C of the core component 2 by a parallel-shifting motor.

Figure 12:
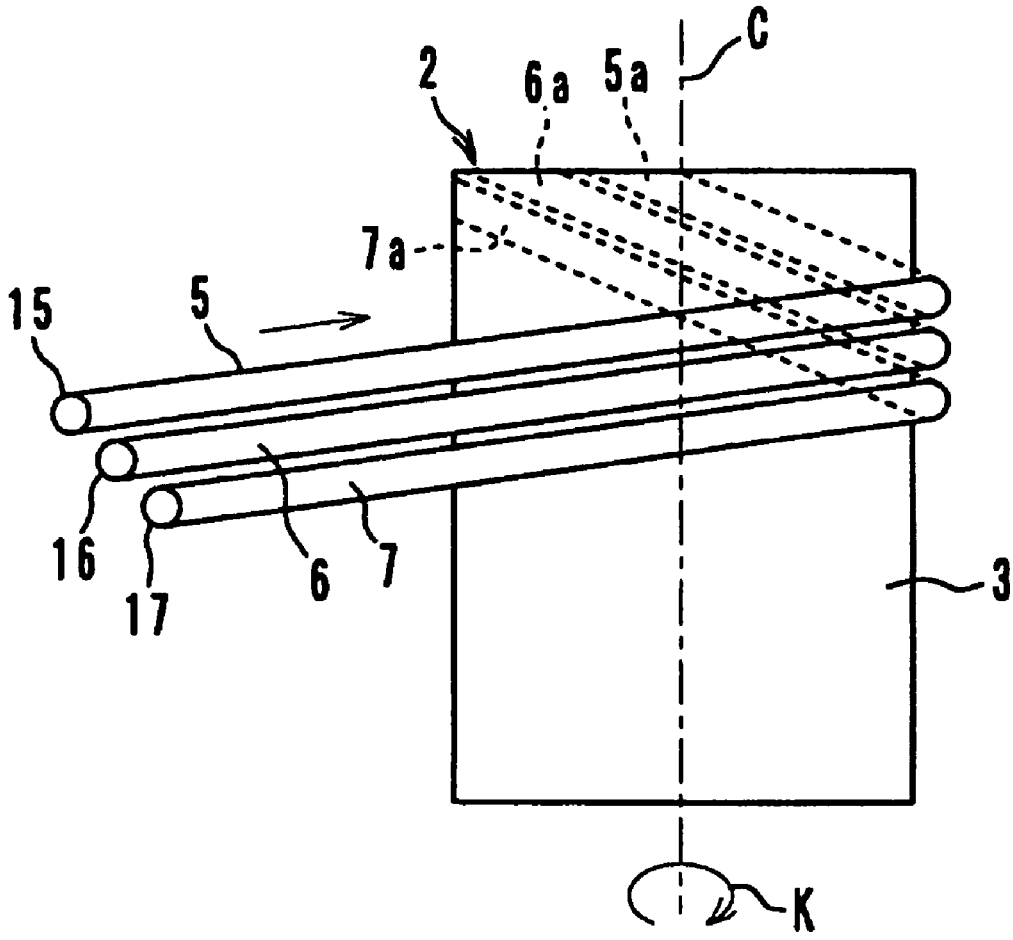
FIG. 12 is a plan view illustrating another step following the step in FIG. 11.
Figure 13:
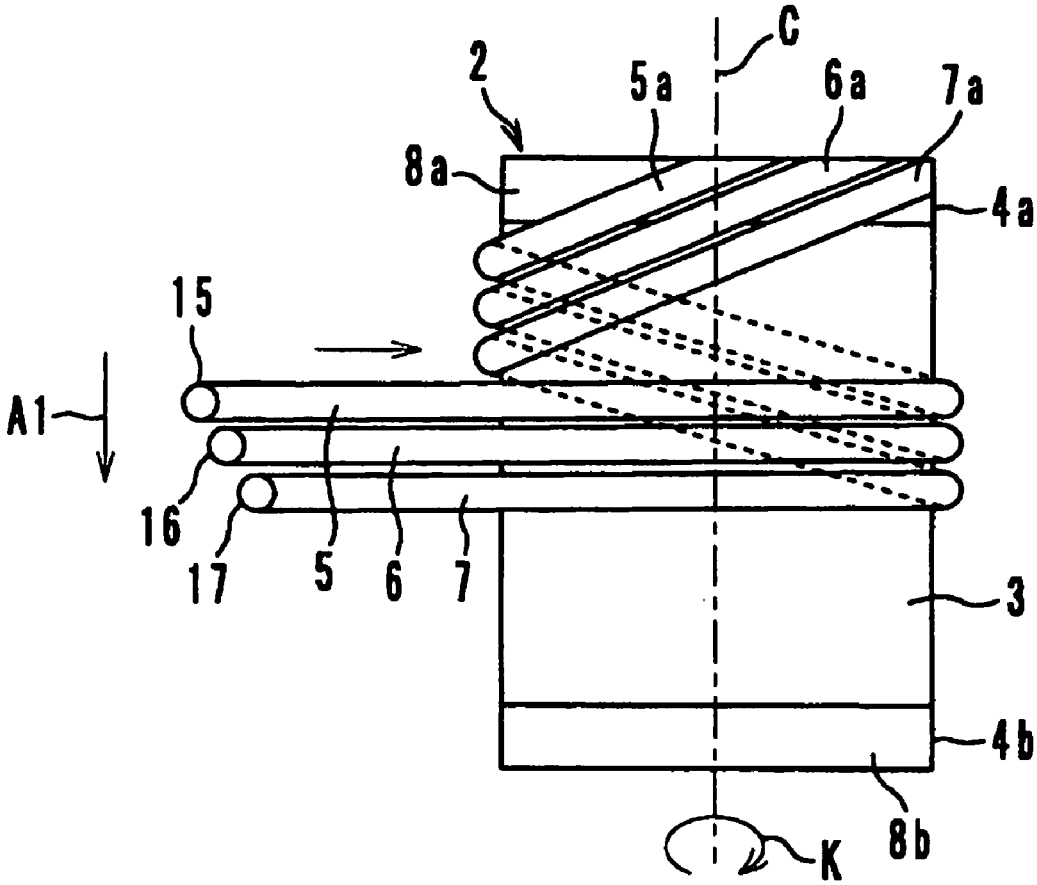
FIG. 13 is a plan view illustrating another step following the step in FIG. 12.

Referring to FIG. 12, when the core component 2 is rotated by approximately 180° around the central axis C in the direction of the arrow K, the wires 5, 6, and 7 are wound around a first layer position of the core plate 3 while being kept parallel or substantially parallel and substantially in contact with one another. Referring to FIG. 13, when the core component 2 is further rotated by 180°, the wires 5, 6, and 7 wrap completely around the core plate 3 while still being kept parallel or substantially parallel to one another so as to form a first turn.

Subsequently, while the wire-supplying nozzles 15, 16, and 17 are shifted forward in the direction of the arrow A1, which is substantially parallel to the central axis C of the core component 2, the core component 2 is further rotated so as to wind the wires 5, 6, and 7 around the core plate 3. This starts a winding process for a second turn in the first layer position of the core plate 3 while the second turn is in contact with the first turn.

Figure 14:
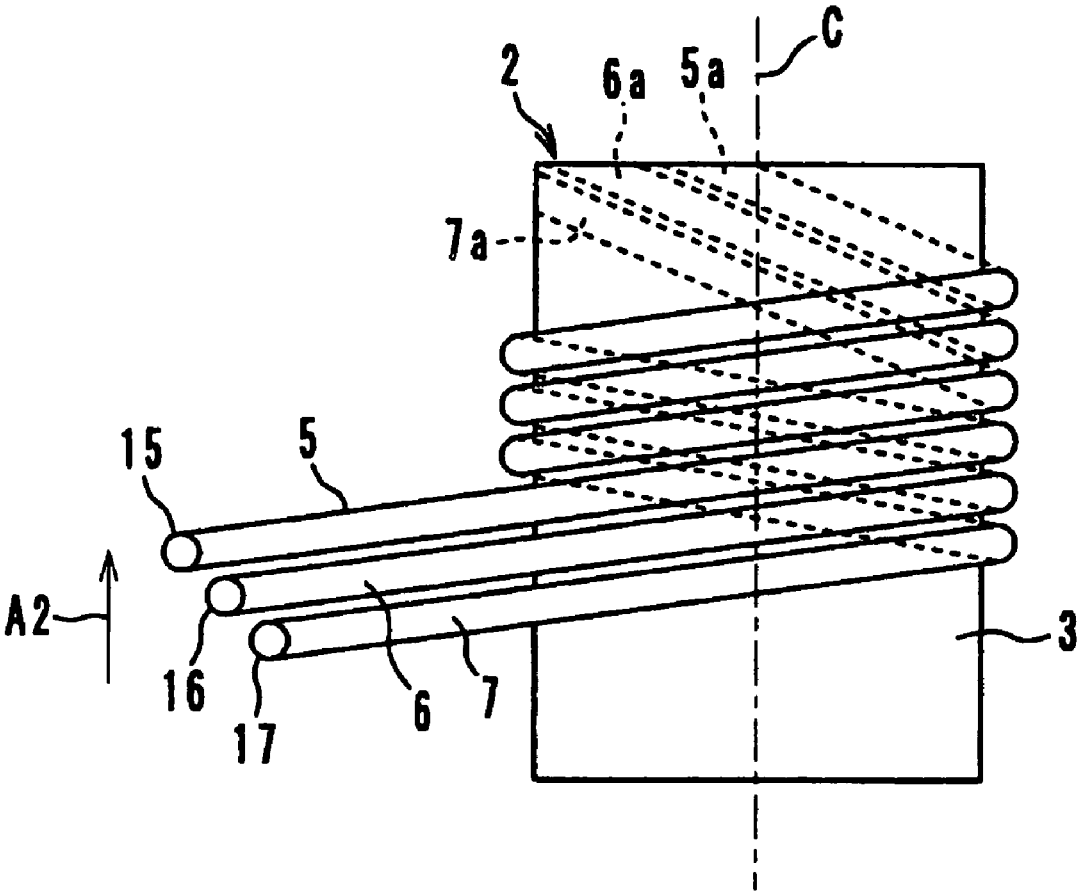
FIG. 14 is a plan view illustrating another step following the step in FIG. 13.
Figure 15:
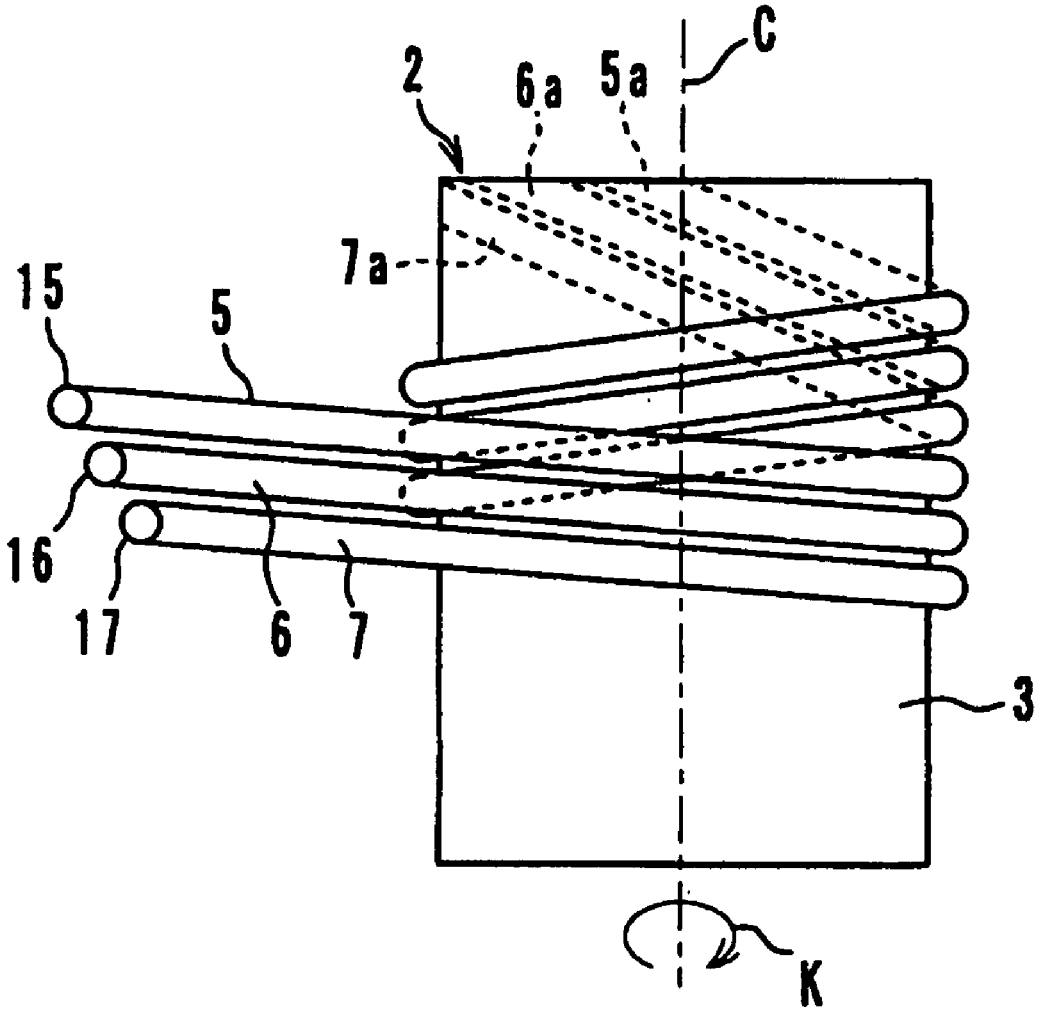
FIG. 15 is a plan view illustrating another step following the step in FIG. 14.

Referring to FIG. 14, after the core component 2 is rotated by approximately 180°, the wire-supplying nozzles 15, 16, and 17 are shifted backwards in the direction of the arrow A2 (opposite to the direction of the arrow A1), which is substantially parallel to the central axis C of the core component 2. In detail, referring to FIG. 15, the wire-supplying nozzles 15, 16, and 17 are shifted backwards by a distance approximately ⅚ of the winding pitch of the first wire 5. Thus, the wires 5 and 6 of the second turn, which are positioned closer to the first turn of the wires 5, 6, and 7, are respectively disposed on a section between the first wire 5 and the second wire 6 of the first turn and on a section between the second wire 6 and the third wire 7 of the first turn. The wires 5 and 6 of the second turn are thus wound around the core plate 3 to form the second layer. On the other hand, the third wire 7 of the second turn is disposed in the first layer of the core plate 3 while being adjacent to and in contact with the third wire 7 of the first turn.

Figure 16:
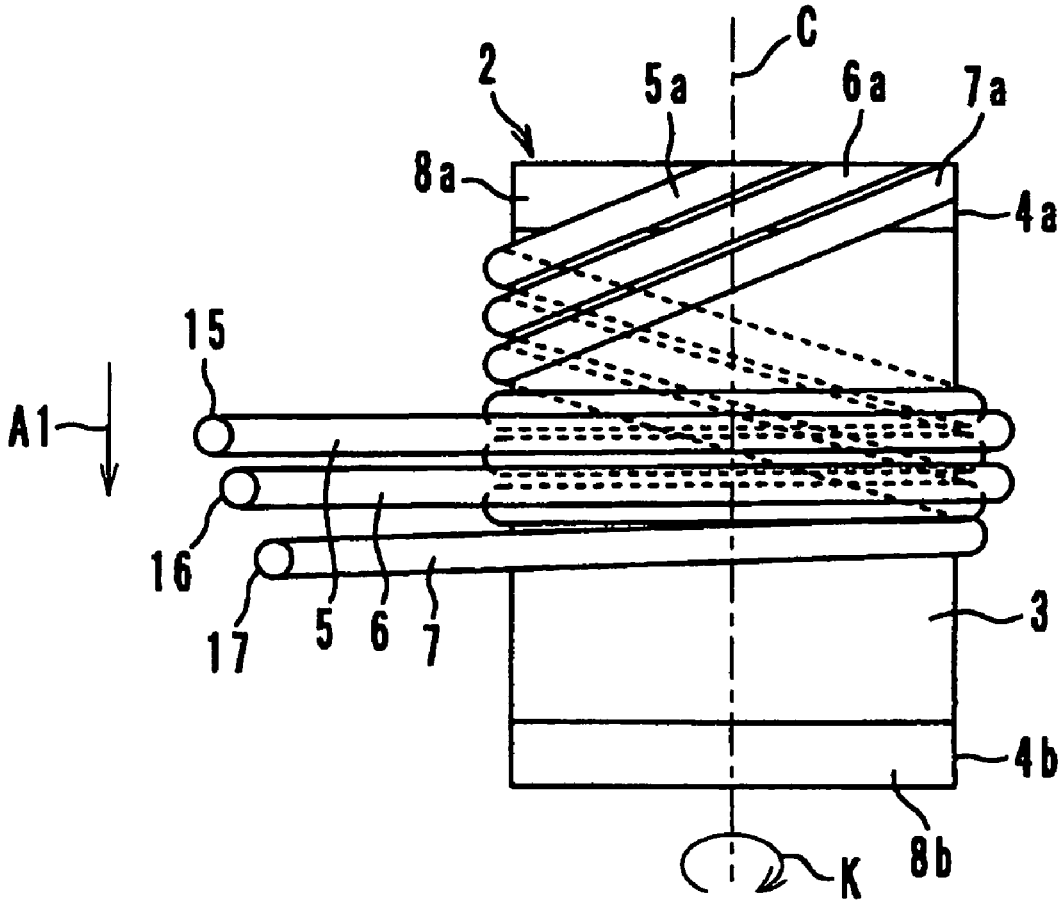
FIG. 16 is a plan view illustrating another step following the step in FIG. 15.

Subsequently, referring to FIG. 16, the core component 2 is further rotated by approximately 180° while the wire-supplying nozzles 15, 16, and 17 are shifted forward in the direction of the arrow A1. This completes the formation of the second turn of the wires 5, 6, and 7.

Figure 17:
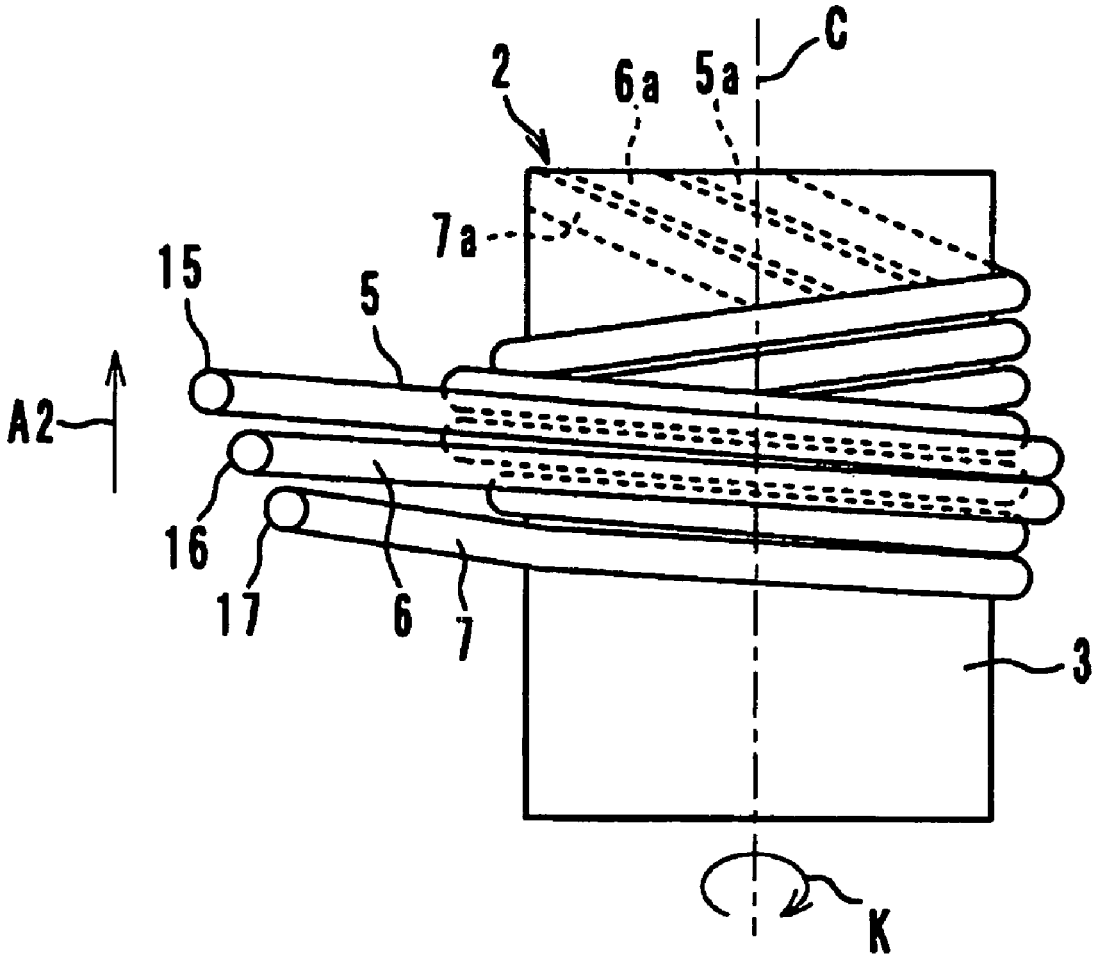
FIG. 17 is a plan view illustrating another step following the step in FIG. 16.

Referring to FIG. 17, the core component 2 is further rotated by approximately 180° while the wire-supplying nozzles 15, 16, and 17 are shifted backwards in the direction of the arrow A2 (opposite to the direction of the arrow A1) so as to wind the wires 5, 6, and 7 around the core plate 3. This starts a winding process for a third turn. The first wire 5 of the third turn is wound around the third layer position of the core plate 3 while being disposed on a section between the first wire 5 and the second wire 6 of the second turn in the second layer. The second wire 6 of the third turn is disposed on a section between the third wire 7 of the first turn and the third wire 7 of the second turn in the first layer, such that the second wire 6 of the third turn is wound around the second layer position of the core plate 3 while being adjacent to and in contact with the second wire 6 of the second turn in the second layer. The third wire 7 of the third turn is wound around the first layer position of the core plate 3 while being adjacent to and in contact with the third wire 7 of the second turn.

Subsequently, the core component 2 is rotated a predetermined number of times to wind the wires 5, 6, and 7 around the core plate 3 while the wire-supplying nozzles 15, 16, and 17 are shifted forward in the direction of the arrow A1. Accordingly, the third wire 7 forms the first layer of the core plate 3. The second wire 6 is wound around a section between adjacent turns of the third wire 7 in the first layer so as to be disposed in the second layer position of the core plate 3 while the adjacent turns of the second wire 6 are in contact with each other. The first wire 5 is wound around a section between adjacent turns of the second wire 6 in the second layer so as to be disposed in the third layer position of the core plate 3 while the adjacent turns of the first wire 5 are in contact with each other.

After the winding process of the wires 5, 6, and 7 is completed, second ends 5*b*, 6*b*, and 7*b* of the respective wires 5, 6, and 7 are fixed to and electrically connected to the electrode 8*b* in the leg portion 4*b* by, for example, thermo-compression bonding.

Figure 18:
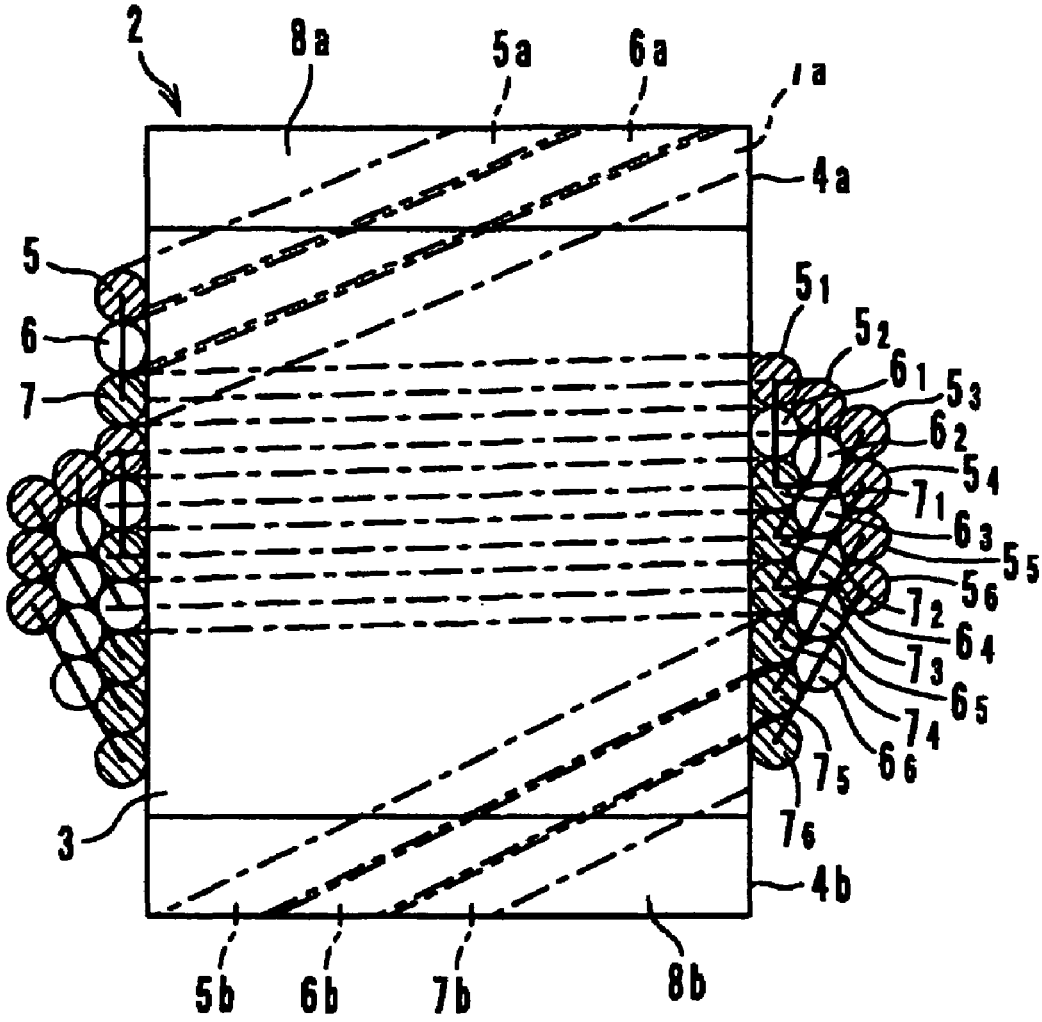
FIG. 18 is a schematic cross-sectional view illustrating a state where the wires are wound around the core plate of the coil unit.

FIG. 18 is a schematic cross-sectional view illustrating a state where the wires 5, 6, and 7 are wound around the core plate 3. As is apparent from FIG. 18, the first turn of the wires 5, 6, and 7 wound around the core plate 3 is asymmetrical to the last turn of the wires 5, 6, and 7.

According to the coil-winding method of the second preferred embodiment described above, the first layer of the third wire 7 can be formed on the core plate 3 while simultaneously forming the second wire 6 of the second layer over the first layer and the first wire 5 of the third layer over the second layer, meaning that the three wires 5, 6, and 7 can be wound around the core plate 3 at the same time. Accordingly, a triple-layered coil unit 1 can be obtained, in which the wires 5, 6, and 7 in the respective first, second, and third layers are wound parallel or substantially parallel to one another. Thus, the time required for the winding process according to the second preferred embodiment of the present invention is about one-third of the time required in the conventional winding process.

Alternative Preferred Embodiments

The technical scope of the present invention is not limited to the above-described preferred embodiments, and modifications are permissible within the scope and spirit of the present invention. For example, the coil unit 1 may be a multilayered coil unit having four or more layers in which the wires are disposed parallel or substantially parallel to one another. Furthermore, the coil unit 1 may be, for example, a bifilar-wound coil unit or a trifilar-wound coil unit.

While the present invention has been described with respect to preferred embodiments, it will be apparent to those skilled in the art that the disclosed invention may be modified in numerous ways and may assume many embodiments other than those specifically set out and described above. Accordingly, it is intended by the appended claims to cover all modifications of the invention which fall within the true spirit and scope of the invention.

What is claimed is:

1. A coil-winding method for forming a wire-wound coil unit, comprising the steps of:

winding a first wire and a second wire simultaneously around a first layer position of a core so as to form a first turn, the first wire and the second wire being substantially parallel to each other;

winding the first wire and the second wire simultaneously around the core to form a second turn, the first wire of the second turn being adjacent to the first turn, the first wire of the second turn being disposed on a section between the first wire and the second wire of the first turn in the first layer of the core such that the first wire of the second turn is disposed in a second layer of the core, the second wire of the second turn being wound directly around the core such that the second wire of the second turn is disposed in the first layer of the core; and winding the first wire and the second wire simultaneously around the core to form a third turn, the first wire of the third turn being disposed in the second layer and wound around a section between the second wire of the first turn and the second wire of the second turn in the first layer, the second wire of the third turn being wound directly around the core such that the second wire of the third turn is disposed in the first layer of the core.

2. The method according to claim 1, wherein the wire-wound coil unit includes a multilayered wire-wound coil unit in which the wires in multiple layers are substantially parallel to one another.

3. The method according to claim 1, further comprising the step of connecting ends of the first and second wires to bottom surfaces of first and second leg portions of the core.

4. The method according to claim 1, further comprising the step of attaching a resin cover having magnetic particles to the core so as to cover the first and second wires.

5. The method according to claim 1, further comprising the step of rotating the core by approximately 180° about a central axis thereof during at least one of the steps of winding.

6. The method according to claim 1, further comprising the step of rotating the core by approximately 180° about a central axis thereof at least once during each of the steps of winding.

7. The method according to claim 1, wherein the first and second wires are supplied by wire-supplying members during the steps of winding, the method further comprising the step of shifting the wire-supplying members in a direction that is substantially parallel to a longitudinal axis of the core in between at least two of the winding steps.

8. The method according to claim 1, wherein the first and second wires are supplied by wire-supplying members during the steps of winding, the method further comprising the step of shifting the wire-supplying members in a direction that is substantially parallel to a longitudinal axis of the core in between each of the winding steps.

9. The method according to claim 1, wherein the first and second wires are supplied by wire-supplying members during the steps of winding, the method further comprising the steps of shifting the wire-supplying members in a first direction that is substantially parallel to a longitudinal axis of the core in between a first two of the winding steps and shifting the wire-supplying members in a second direction that is opposite to the first direction in between a second two of the winding steps.

10. A coil-winding method for forming a wire-wound coil unit, comprising the steps of:

winding a first wire, a second wire, and a third wire simultaneously around a first layer position of a core so as to form a first turn, the first, second, and third wires being substantially parallel to one another;

winding the first, second, and third wires simultaneously around the core to form a second turn, the first and second wires of the second turn being closer to the first turn than the third wire of the second turn, the first wire of the second turn being disposed on a section between the first wire and the second wire of the first turn in the first layer of the core such that the first wire of the second turn is disposed in a second layer of the core, the second wire of the second turn being disposed on a section between the second wire and the third wire of the first turn in the first layer such that the second wire of the second turn is also disposed in the second layer, the third wire of the second turn being wound directly around the core such that the third wire of the second turn is disposed in the first layer of the core;

winding the first, second, and third wires simultaneously around the core to form a third turn, the second wire of the third turn being wound around a section between the third wire of the first turn and the third wire of the second turn in the first layer such that the second wire of the third turn is disposed in the second layer, the first wire of the third turn being wound around a section between the first wire of the second turn and the second wire of the second turn in the second layer such that the first wire of the third turn is disposed in a third layer of the core, the third wire of the third turn being wound directly around the core such that the third wire of the third turn is disposed in the first layer of the core; and winding the first, second, and third wires simultaneously around the core such that the first wire of the third layer is wound around a section between adjacent turns of the second wire in the second layer, the second wire of the second layer is wound around a section between adjacent turns of the third wire in the first layer, and the third wire of the first layer is wound directly around the core.

11. The method according to claim 10, wherein the wire-wound coil unit includes a multilayered wire-wound coil unit in which the wires in multiple layers are substantially parallel to one another.

12. The method according to claim 10, further comprising the step of connecting ends of the first, second and third wires to bottom surfaces of first and second leg portions of the core.

13. The method according to claim 10, further comprising the step of attaching a resin cover having magnetic particles to the core so as to cover the first, second and third wires.

14. The method according to claim 10, further comprising the step of rotating the core by approximately 180° about a central axis thereof during at least one of the steps of winding.

15. The method according to claim 10, further comprising the step of rotating the core by approximately 180° about a central axis thereof at least once during each of the steps of winding.

16. The method according to claim 10, wherein the first, second and third wires are supplied by wire-supplying members during the steps of winding, the method further comprising the step of shifting the wire-supplying members in a direction that is substantially parallel to a longitudinal axis of the core in between at least two of the winding steps.

17. The method according to claim 10, wherein the first, second and third wires are supplied by wire-supplying members during the steps of winding, the method further comprising the step of shifting the wire-supplying members in a direction that is substantially parallel to a longitudinal axis of the core in between each of the winding steps.

18. The method according to claim 10, wherein the first, second and third wires are supplied by wire-supplying members during the steps of winding, the method further comprising the steps of shifting the wire-supplying members in a first direction that is substantially parallel to a longitudinal axis of the core in between a first two of the winding steps and shifting the wire-supplying members in a second direction that is opposite to the first direction in between a second two of the winding steps.

* * * * *